US006431159B2

(12) United States Patent
Nishi et al.

(10) Patent No.: US 6,431,159 B2
(45) Date of Patent: Aug. 13, 2002

(54) OIL SEPARATOR STRUCTURE OF INTERNAL COMBUSTION ENGINE

(75) Inventors: Tohru Nishi; Ken Oike, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,670

(22) Filed: Jul. 11, 2001

(30) Foreign Application Priority Data

Jul. 11, 2000 (JP) ..... 2000-209372

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS 5,123,385 A * 6/1992 Sado et al. ..... 123/572
5,261,380 A * 11/1993 Romano ..... 123/573
5,542,402 A * 8/1996 Lee et al. ..... 123/573
5,617,834 A * 4/1997 Lohr ..... 123/572

FOREIGN PATENT DOCUMENTS

JP A61138811 6/1986
JP Y2627778 7/1994

* cited by examiner

*Primary Examiner*—Marguerite McMahon
(74) *Attorney, Agent, or Firm*—Birch, Stewart, Kolasch & Birch, LLP

(57) ABSTRACT

An oil separating chamber for separating oil contained in blow-by gas is arranged outside a transmission member passage connecting a crank shaft with a cam shaft of a valve system and at an abutting surface between a cylinder block and a cylinder head. Partition walls perpendicular to the abutting surface for dividing the oil separating chamber into a plurality of small subchambers are alternatively arranged at the cylinder block and the cylinder head to form a labyrinth structure. The small subchamber at one end of the plurality of small subchambers is provided with a blow-by gas intake passage communicated with the transmission member passage. The small subchamber at the other end is provided with a blow-by gas exhaust passage for returning blow-by gas to an air cleaner. Each of the small subchambers not provided with the blow-by gas intake passage is provided with an oil return passage communicating with the transmission member passage. This arrangement and construction of an oil separator structure for separating oil contained in blow-by gas of an internal combustion engine reduces the number of component parts and the number of assembling steps.

20 Claims, 7 Drawing Sheets

OIL SEPARATOR STRUCTURE OF INTERNAL COMBUSTION ENGINE

BACKGROUND OF THE INVENTION

1. Field of the Invention

The present invention relates to an oil separator structure for use in separating oil contained in blow-by gas exhausted from an internal combustion engine, and more particularly, to both an arrangement and a construction of an oil separator chamber.

2. Description of the Background Art

As one example of the oil separator of the conventional internal combustion engine, there is provided an oil separator disclosed in the gazette of Japanese Examined Utility Model Publication No. Hei 6-27778. As shown in FIG. 9 of the perspective view showing an exploded state, a frame-like outer circumferential wall 06 projected outwardly is integrally arranged in cooperation with a sidewall 05 ranging from a lower part of a vertical wall of a cylinder block 01 to a skirt segment in an oil separator 03 installed at an outside segment of the cylinder block 01. A lid plate 07 is connected to the outer circumferential wall 06. Thereby, an oil separator chamber 04 is formed by the cylinder block side wall 05, the outer circumferential wall 06 and the lid plate 07.

Although a plurality of oil baffles 013, 014 are arranged within this oil separator chamber 04 so as to cause its inner side to become a labyrinth, the outer circumferential wall 06 is arranged to enclose a part of the reinforcing rib 015 of the cylinder block 01. This reinforcing rib 015 is constituted as one oil baffle 013 within the oil separator chamber 04. As shown in FIG. 9, another oil baffle 014 is cooperatively arranged within a predetermined range of the sidewall 05 of the cylinder block 01. Then, both a blow-by gas intake port 011 and a blow-by gas exhaust port 012 are arranged at positions where these oil baffles 013, 014 are held. The blow-by gas intake port 011 is formed at the cylinder block sidewall 05 in a punched-out shape and the blow-by gas exhaust port 012 is formed at the lid plate 07.

In addition, the oil separator disclosed in the gazette of Japanese Patent Laid-Open No. Sho 61-138811 as another example of the oil separator of the conventional internal combustion engine is constructed such that a side surface of the cylinder head 021 is provided with a cap 026 for sealingly closing a cam shaft mounting space 023 of a four-stroke engine of a type in which a cam shaft 022 is pivotally supported at the cylinder head 021 as shown in FIG. 10. The cam shaft 022 is driven by a sprocket 024 and a chain 025 or the like installed between it and a crank shaft (not shown).

The cap 026 is formed by a hollow member and at the same time its inner space 027 is communicated with the crank chamber and the surrounding atmosphere to act as a breather chamber. That is, the cap 026 is formed with both a gas inlet 029 communicating the inner space 027 with a cam shaft mounting space 023, and an oil return hole 030 communicated with a chain tunnel 028. The upper segment of the cap 026 is provided with a surrounding atmosphere communication hole 031 communicating the inner space 027 with the surrounding atmosphere. In addition, ribs 032, 032 alternatively projecting from both its inner wall and outer wall are formed in the inner space 027 to constitute a labyrinth for gas flowing in the inner space 027.

In the aforesaid oil separator of the conventional internal combustion engine, the oil separator was formed by assembling the baffle plates or lid plate, and cap or the like to composing members of the internal combustion engine such as the cylinder block or the cylinder head and the like, so that this prior art had a problem that the number of component elements and the number of assembling steps are increased.

SUMMARY OF THE INVENTION

In order to solve the aforesaid problem, the oil separator structure of the internal combustion engine of the present invention is characterized in that an oil separating chamber for separating oil contained in blow-by gas is arranged outside a transmission member passage connecting a crank shaft with a cam shaft of a valve system and at an abutting surface between a cylinder block and a cylinder head. Partition walls are alternatively arranged at the cylinder block and the cylinder head perpendicular to the abutting surface for dividing the oil separating chamber into a plurality of small subchambers to form a labyrinth structure. The small subchamber at one end of the plurality of small subchambers is provided with a blow-by gas intake passage communicated with the transmission member passage. The small subchamber at the other end of the plurality of small subchambers is provided with a blow-by gas exhaust passage for returning blow-by gas to an air cleaner. Each of the small subchambers not provided with the blow-by gas intake passage is provided with an oil return passage communicating with the transmission member passage.

The present invention is constructed as described above and the oil separator structure is formed under utilization of an abutting surface between the cylinder block and the cylinder head of the basic structural members of the internal combustion engine, so that the number of component elements and the number of assembling steps are reduced as compared with the prior art, and so the costs become less expensive.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION OF THE PREFERRED EMBODIMENTS

Figure 1:
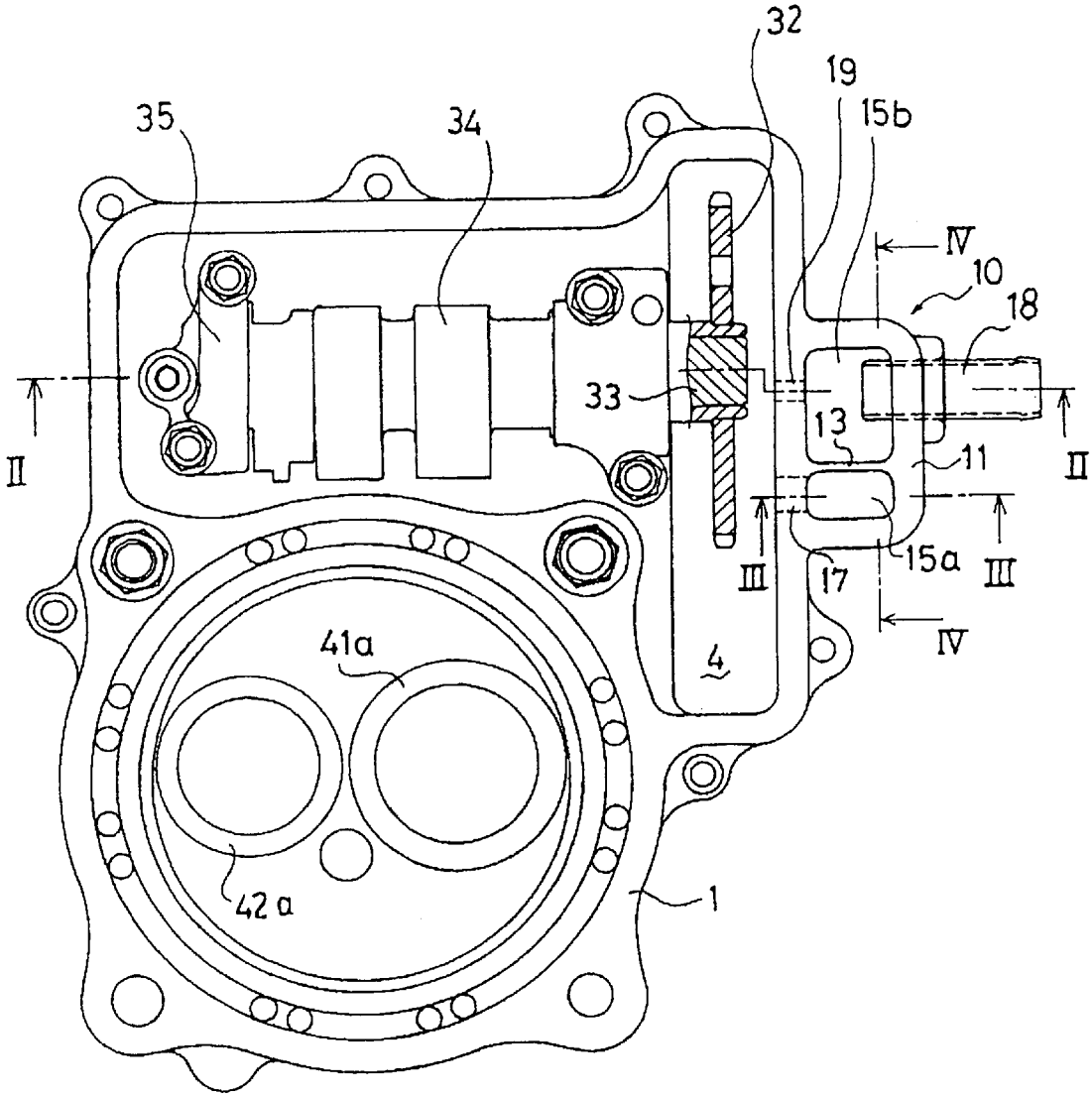
FIG. 1 is a top plan view showing the preferred embodiment of the present invention in which the upper surface of a cylinder block is shown together with a cylinder head and a part of a valve system.
Figure 2:
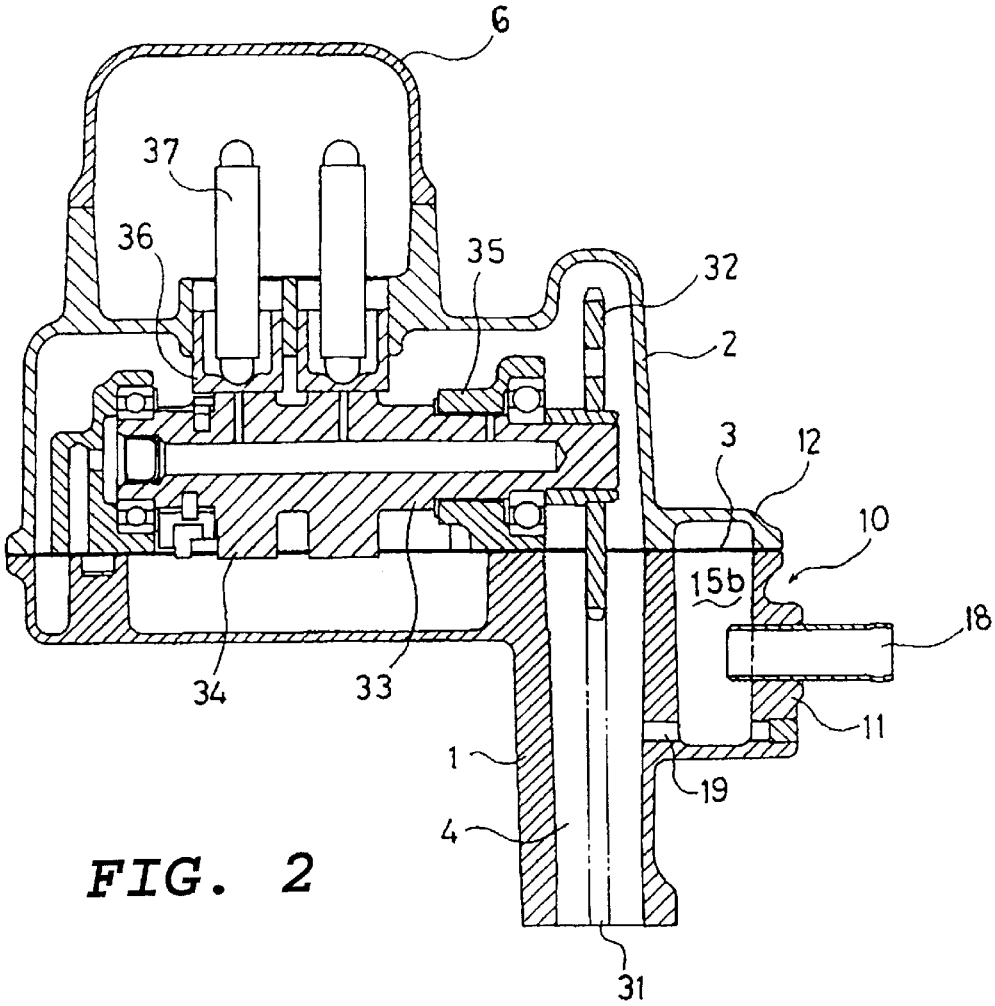
FIG. 2 is a sectional side elevational view taken along line II—II of FIG. 1.
Figure 3:
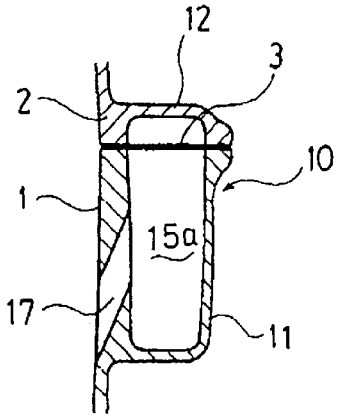
FIG. 3 is a sectional side elevational view taken along line III—III of FIG. 1.
Figure 6:
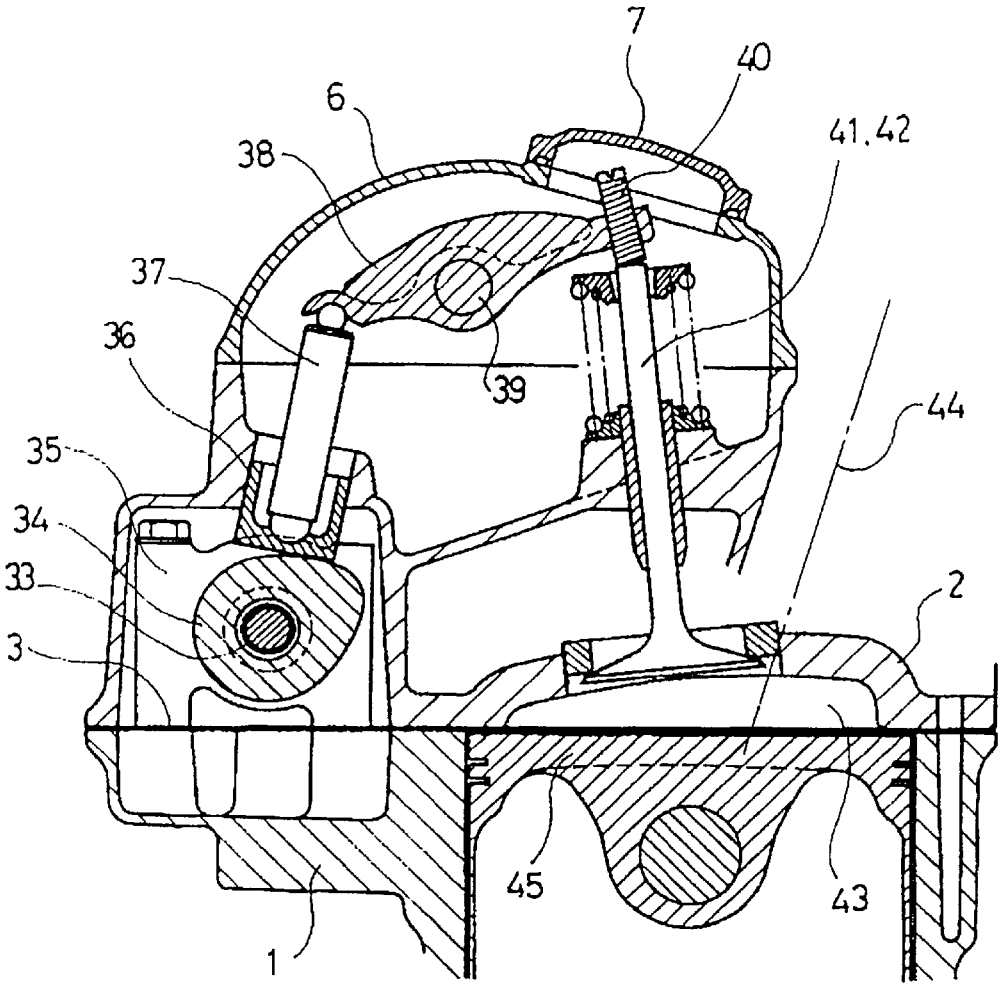
FIG. 6 is a sectional front elevational view showing an upper segment and the valve system from above a cylinder block.

FIGS. 1, 2 and 6 show a cylinder block 1 of an internal combustion engine, and a cylinder head 2 connected to the cylinder block 1 with a cylinder gasket (not shown) being held between them. A transmission member passage 4 extends between the crank shaft and a cam shaft of the valve system. The left side in FIGS. 1 and 2 corresponds to the forward location when the oil separator structure is mounted on a vehicle, and the right side in FIGS. 1 and 2 similarly corresponds to the rearward location.

In the preferred embodiment of the present invention, the abutting surface between the cylinder block 1 and the cylinder head 2 (the surface 3 of the cylinder head deck) outside the transmission member passage 4 is provided with an oil separation chamber 10 for separating oil contained in blow-by gas as shown in FIGS. 1 to 4. A lower outside wall 11 is integrally arranged outside the cylinder block 1, and an upper outside wall 12 is integrally arranged outside the cylinder head 2. The oil separation chamber 10 is formed by the lower outside wall 11 and the upper outside wall 12.

Figure 4:
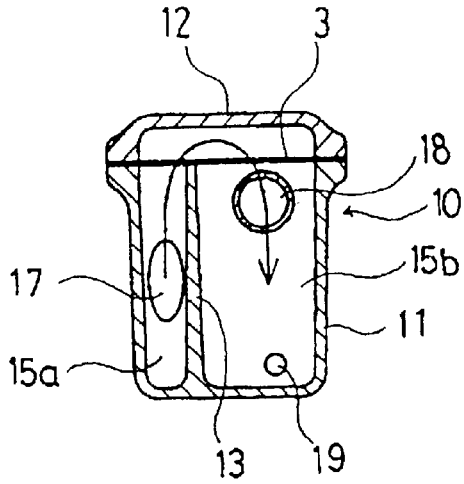
FIG. 4 is a sectional rear view taken along line IV—IV of FIG. 1.

A lower partition wall 13 perpendicular to the aforesaid abutting surface 3 is integrally arranged with the lower outer wall 11, so that the aforesaid oil separation chamber 10 is divided into a plurality of small subchambers 15*a*, 15*b* (two in the example shown in the figure) and an inverse U-shaped labyrinth is formed (FIG. 4). One small subchamber 15*b* of the plurality of small subchambers 15*a*, 15*b* is provided with the blow-by gas intake passage 17 communicated with the transmission member passage 4, and the other small subchamber 15*b* is provided with a blow-by gas exhaust passage 18 returning the blow-by gas to an air cleaner (not shown) and with an oil return passage 19 communicated with the transmission member passage 4.

As a gas leakage (blow-by gas) is produced at a crank chamber (not shown) from a combustion chamber through a piston-sliding arrangement, pressure within the crank chamber is increased with the blow-by gas and at the same time, the engine oil agitated under motion of the crank is mixed with blow-by gas. The blow-by gas containing this oil ascends in the transmission member passage 4, passes through the blow-by gas intake passage 17 and is fed into the small subchamber 15*a*.

Then, after the blow-by gas ascends in the small subchamber 15*a*, it U-turns as shown by an arrow in FIG. 4, enters the small subchamber 15*b*, the gas is exhausted from the blow-by gas exhaust passage 18 and returned back to an air cleaner not shown. During this operation, the engine oil is separated, passes from the oil return passage 19 and the blow-by gas intake passage 17 and is returned back to the crank chamber through the transmission member passage 4.

In the preferred embodiment of the present invention, the oil separator structure is formed by the members integrally formed with the cylinder block 1 and the cylinder head 2 under utilization of the abutment surface 3 between the cylinder block 1 and the cylinder head 2 of the basic composing members of the internal combustion engine. The separate component parts such as the baffle plate or the lid plate and the cap or the like as those in the conventional oil separator are therefore not required, resulting in a reduction in the number of component parts and the number of assembling steps as compared with the conventional system, and so the price becomes less expensive.

In addition, since the preferred embodiment of the present invention is made such that the rear segment of the internal combustion engine is provided with the oil separator, its distance up to the air cleaner becomes short and the length of the breather hose can be made short, resulting in a decrease in cost.

Figure 5:
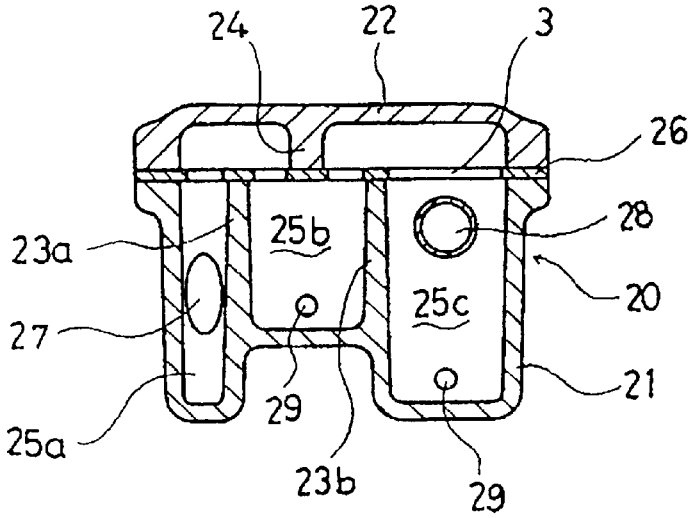
FIG. 5 is a view showing one example of a modification of FIG. 4.

FIG. 5 is a rear sectional view corresponding to FIG. 4 of a modification of the oil separator of the preferred embodiment of the present invention. In this modification, an oil separator chamber 20 is formed by a lower outer wall. 21 and an upper outer wall 22 arranged outside the cylinder block 1 and outside the cylinder head 2, respectively.

The lower partition walls 23*a*, 23*b* perpendicular to the abutting surface 3 between the cylinder block 1 and the cylinder head 2 are integrally arranged with the lower outer wall 21, so that the oil separator chamber 20 is divided into three small subchambers 25*a*, 25*b*, 25*c*. The upper partition wall 24 integral with the upper outer wall 22 is arranged between the lower partition walls 23*a*, 23*b*, and its entire structure is formed into an inverse W-shaped labyrinth structure.

One end subchamber 25*a* is provided with a blow-by gas intake passage 27. The other end subchamber 25*c* is provided with a blow-by gas exhaust passage 28. The subchambers 25*b*, 25*c* are provided with an oil return passage 29. In this modification, the constitution of the labyrinth is complex, and separation of oil is carried out more effectively. Further, an area of the passage may be adjusted by the cylinder gasket 26.

Referring to FIGS. 1, 2, 6 and 7, the valve system of the preferred embodiment of the present invention will be described. Rotation of the crank shaft (not shown) is transmitted to a cam sprocket 32 by a cam chain 31 to rotate the cam shaft 33 and the cam 34. In the preferred embodiment of the present invention, a cam holder 35 for rotatably supporting the cam shaft 33 is fixed to the cylinder head deck surface 3. Rotation of the cam 34 causes a push rod 37 to be reciprocated up and down through a cylindrical follower 36, causes a rocker arm 38 to be oscillated around the rocker arm shaft 39, and further causes an intake valve 41 and an exhaust valve 42 to be opened or closed through an adjustment screw 40. Mixture gas of fuel and air sucked into a combustion chamber 43 through the intake valve 41 is ignited by a spark plug whose axis is indicated by a dotted line 44, and then burnt to push down a piston 45 to drive the internal combustion engine.

Adjustment of a valve clearance is carried out through rotation of the adjustment screw 40. Reference numeral 6 in the figure denotes a head cover, and reference numeral 7 denotes a tappet hole cap. Circles 41*a*, 42*a* in FIGS. 1 and 7 denote valve seat positions for the intake and exhaust valves, respectively.

In the preferred embodiment of the present invention, the rocker arm shaft 39 is parallel with the cam shaft 33. Only one of each of the intake valve 41 and the exhaust valve 42 is arranged, and a line connecting centers of the valve seats 41*a*, 42*a* of these intake valve 41 and exhaust valve 42 is also parallel with the cam shaft 33.

Figure 7:
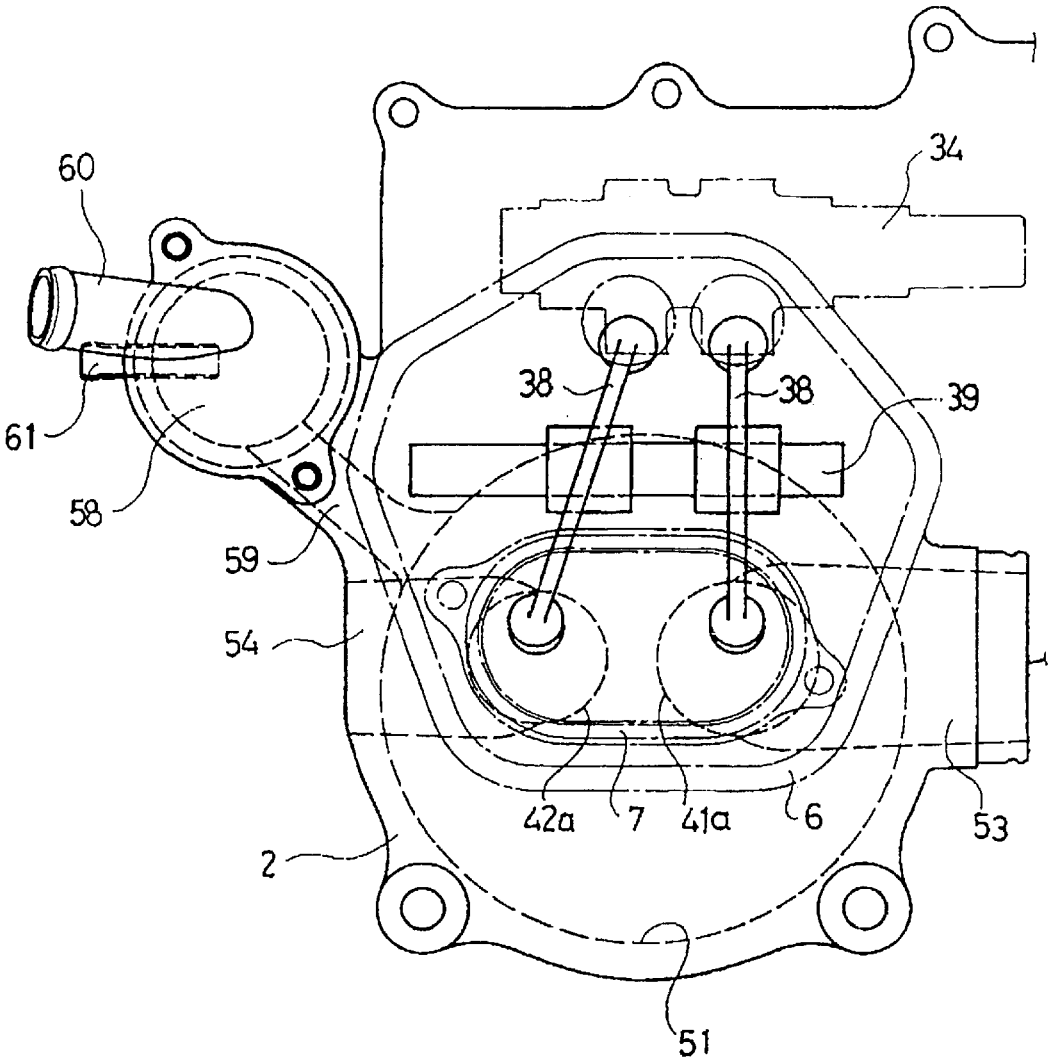
FIG. 7 is a top plan view showing a cylinder head.
Figure 8:
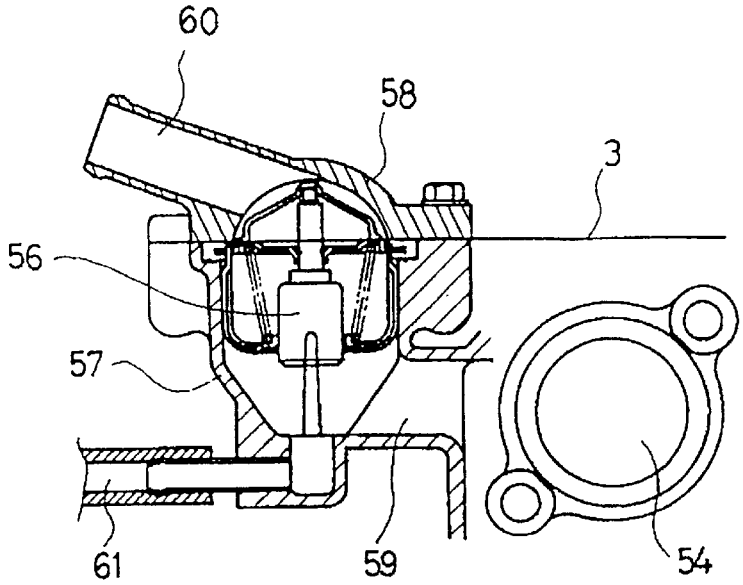
FIG. 8 is a longitudinal side elevational view in section showing a thermostat.
Figure 9:
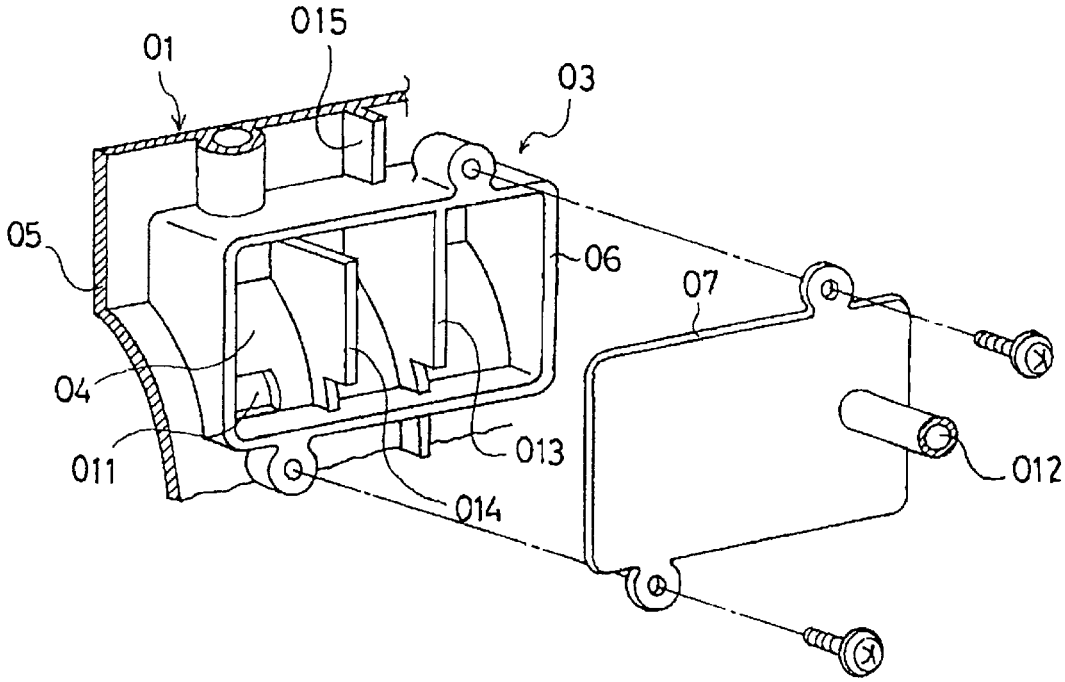
FIG. 9 is a view showing one example of an oil separator of the conventional internal combustion engine.
Figure 10:
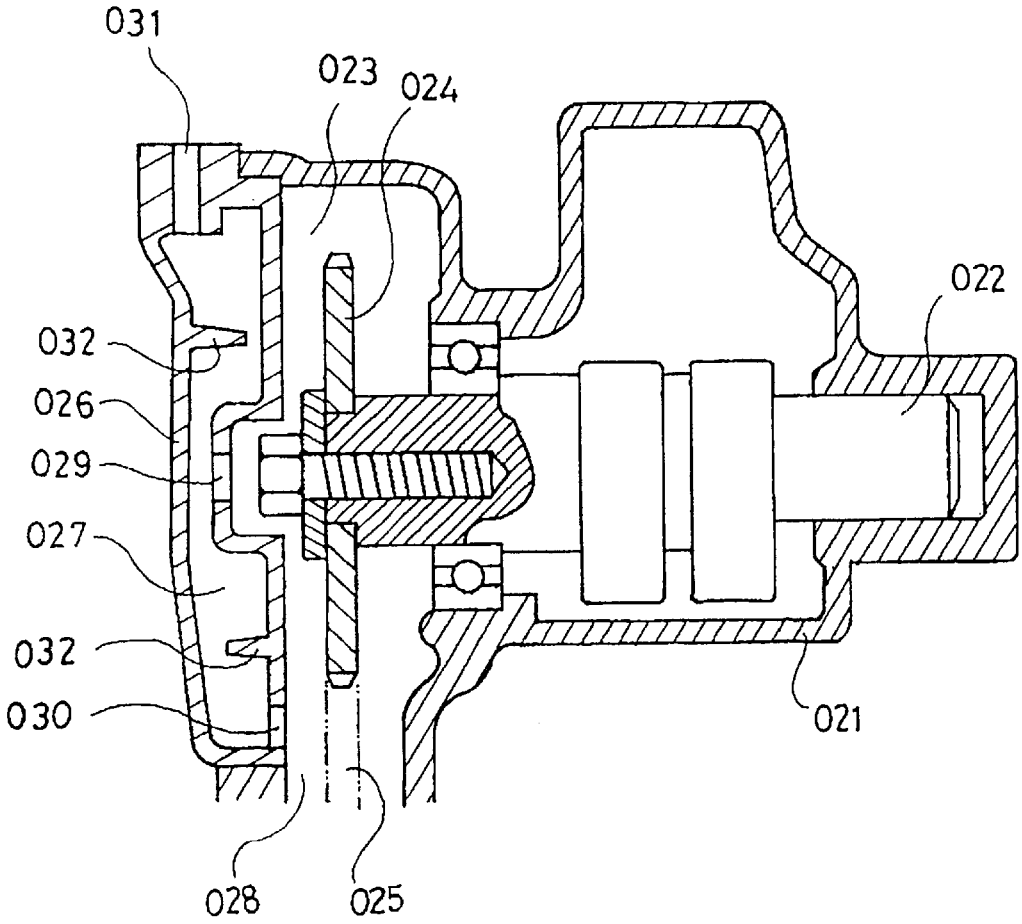
FIG. 10 is a view showing another example of an oil separator of the conventional internal combustion engine.

Referring to FIGS. 7 and 8, a cooling device in the preferred embodiment of the present invention will be described as follows. A dotted line circle 51 in FIG. 7 denotes a wall surface of a water jacket of the cylinder head 2. In addition, each of reference numerals 53, 54 denotes an intake port and an exhaust port, respectively.

In the preferred embodiment of the present invention, a thermostat case 57 adjacent to the exhaust port 54 outside the cylinder head 2 and communicated with the water jacket 51 of the cylinder head by a passage 59 is integrally formed with the cylinder head 2 at the position where it becomes a forward position of the internal combustion engine under its vehicle mounted state. Then, the thermostat 56 is removably arranged and a lid is applied by the thermostat cover 58.

An abutting surface between the thermostat case 57 and the thermostat cover 58 is coincident with the cylinder head deck surface 3. The seal rubber assembled to the thermostat 56 is press contacted by a groove formed at the cylinder head gasket surface and the flange of the thermostat cover 58. Reference numeral 60 denotes a passage extending to the radiator (not shown), and reference numeral 61 denotes a passage extending to a cooling water pump (not shown).

As already described above, in the preferred embodiment, the upper segment of the cylinder head 2 can be made small, and the supporting position of the rocker arm shaft 39 can be lowered by an arrangement in which a fixing position of the cam holder 35 is set at the cylinder head deck surface 3 while enforcing the fixing of the cam shaft 33 and supporting it in response to an increased load against the journal segment of the cam shaft 33, the rocker arm shaft 39 is set in parallel with the cam shaft 33 and only one of each of the intake valve 41 and the exhaust valve 42 is provided. Accordingly, the size of the entire head cover segment can be reduced and its weight can be decreased, so that the entire height of the internal combustion engine as well as its center of gravity can be set low and this is effective in assuring a space between the upper segment of the internal combustion engine and the frame.

Also in the preferred embodiment of the present invention, a line connecting the centers of the valve seats 41*a*, 42*a* of the intake valve 41 and the exhaust valve 42 is also in parallel with the cam shaft 33, so that one window hole at a side wall of the head cover 6 for use in adjusting a valve clearance can be made, and one tappet hole cap 7 closing the window hole is also satisfactory. The window hole can be made small by reducing a clearance between the intake valve 41 and the exhaust valve 42. In this way, when the valve clearance between the intake valve 41 and the exhaust valve 42 is reduced, only one removable cap is satisfactory, so that its work can be simplified and its working time is shortened. In addition, the number of component parts and the number of machining locations are reduced to cause its manufacturing cost to be reduced.

Further, in the preferred embodiment of the present invention, the thermostat case 57 is integrally formed with the cylinder head 2, so that a structure of the cooling water passage becomes simple and the thermostat cover 58 can be made small and lightweight. In addition, since the thermostat case 57 is adjacent to the exhaust port 54, cooling water can flow effectively to the high temperature segment in the shortest distance and the pressure loss can be reduced while cooling efficiency is increased. Further, since the thermostat 56 is arranged in front of the internal combustion engine while it is mounted on a vehicle, it is possible to shorten a piping of a radiator.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An oil separator structure of an internal combustion engine comprising:

an oil separating chamber for separating oil contained in blow-by gas arranged outside a transmission member passage connecting a crank shaft with a cam shaft of a valve system and at an abutting surface between a cylinder block and a cylinder head;

partition walls perpendicular to said abutting surface for dividing said oil separating chamber into a plurality of small subchambers are alternatively arranged at said cylinder block and said cylinder head to form a labyrinth structure;

the small subchamber at one end of said plurality of small subchambers being provided with a blow-by gas intake passage communicated with said transmission member passage, and the small subchamber at the other end of said plurality of small subchambers being provided with a blow-by gas exhaust passage for returning blow-by gas to an air cleaner, respectively; and each of the small subchambers not provided with said blow-by gas intake passage is provided with an oil return passage communicating with said transmission member passage.

2. An oil separator structure of an internal combustion engine comprising:

a cylinder block having a transmission member passage therein, said cylinder block including a lower wall member extending therefrom adjacent to said transmission member passage;

a cylinder head attachable to said cylinder block, said cylinder head including an upper wall member extending therefrom;

said upper wall member of said cylinder head being attachable to said lower wall member of said cylinder block to form an oil separating chamber located outside of said transmission member passage;

a first partition wall extending from said lower wall member for dividing said oil separating chamber into a first subchamber and a second subchamber to form a labyrinth structure;

said first subchamber being providedith a blow-by gas intake passage connected with said transmission member passage; and said second subchamber being provided with an oil return passage connected with said transmission member passage.

3. The oil separator structure according to claim 2, wherein said blow-by gas intake passage is formed as an aperture in a wall of said cylinder block located between said transmission member passage and said oil separating chamber.

4. The oil separator structure according to claim 3, wherein said aperture forming said blow-by gas intake passage extends obliquely through said wall of said cylinder block at an inclined angle.

5. The oil separator structure according to claim 2, wherein said oil return passage is located in a lower end of said second subchamber.

6. The oil separator structure according to claim 2, wherein said lower wall member is integrally formed with said cylinder block as a one-piece unitary member.

7. The oil separator structure according to claim 6, wherein said upper wall member is integrally formed with said cylinder head as a one-piece unitary member.

8. The oil separator structure according to claim 2, wherein said upper wall member is integrally formed with said cylinder head as a one-piece unitary member.

9. The oil separator structure according to claim 2, wherein said second subchamber further includes a blow-by gas exhaust passage for returning blow-by gas to an air cleaner of said internal combustion engine.

10. The oil separator structure according to claim 9, wherein said blow-by gas intake passage is formed as an aperture in a wall of said cylinder block located between said transmission member passage and said oil separating chamber.

11. The oil separator structure according to claim 9, wherein said lower wall member is integrally formed with said cylinder block as a one-piece unitary member, and said upper wall member is integrally formed with said cylinder head as a one-piece unitary member.

12. The oil separator structure according to claim 2, further comprising a second partition wall extending from said lower wall member for forming a third subchamber adjacent to said second subchamber.

13. The oil separator structure according to claim 12, wherein said third subchamber includes a blow-by gas exhaust passage for returning blow-by gas to an air cleaner of said internal combustion engine.

14. The oil separator structure according to claim 12, wherein said third subchamber includes an oil return passage connected with said transmission member passage.

15. The oil separator structure according to claim 12, further comprising a third partition wall extending from said upper wall member and arranged between said first partition wall and said second partition wall.

16. The oil separator structure according to claim 15, wherein said lower wall member is integrally formed with said cylinder block as a one-piece unitary member, and said upper wall member is integrally formed with said cylinder head as a one-piece unitary member.

17. The oil separator structure according to claim 15, wherein said third subchamber includes a blow-by gas exhaust passage for returning blow-by gas to an air cleaner of said internal combustion engine.

18. The oil separator structure according to claim 17, wherein said third subchamber includes an oil return passage connected with said transmission member passage.

19. The oil separator structure according to claim 18, wherein said lower wall member is integrally formed with said cylinder block as a one-piece unitary member, and said upper wall member is integrally formed with said cylinder head as a one-piece unitary member.

20. The oil separator structure according to claim 19, wherein said blow-by gas intake passage is formed as an aperture extending obliquely at an inclined angle through a wall of said cylinder block located between said transmission member passage and said oil separating chamber.

* * * * *